United States Patent [19]

Terasaki

[11] Patent Number: 4,481,955

[45] Date of Patent: Nov. 13, 1984

[54] CIGARETTE HOLDER WITH TAR COLLECTING MEANS

[76] Inventor: Masahiro Terasaki, 43, Okimiya-cho, Edogawa-ku, Tokyo, Japan

[21] Appl. No.: 502,153

[22] Filed: Jun. 8, 1983

[30] Foreign Application Priority Data

Jul. 29, 1982 [JP] Japan ..... 57-116084[U]

[51] Int. Cl.[3] ..... A24D 3/04

[52] U.S. Cl. ..... 131/216; 131/198 R

[58] Field of Search ..... 131/272, 216, 198 R, 131/198 A, 340, 336, 339

[56] References Cited

U.S. PATENT DOCUMENTS

| | | | |
|---|---|---|---|
| 3,174,487 | 3/1965 | Missler | 131/216 |
| 3,323,525 | 6/1967 | Miller | 131/198 R |
| 3,490,465 | 1/1970 | Kalbfeld | 131/198 R |
| 4,175,571 | 11/1979 | Swanson | 131/272 |
| 4,344,444 | 8/1982 | Miura | 131/210 |
| 4,370,988 | 2/1983 | Terasaki | 131/216 |

*Primary Examiner*—Vincent Millin

*Attorney, Agent, or Firm*—Stevens, Davis, Miller & Mosher

[57] ABSTRACT

A cigarette holder substantially made of an integrally formed body member which includes an outer hollow cylindrical portion with both of its ends open, the inner space within which is divided into a radially larger bore and a radially smaller bore by a transverse dividing wall portion, from which an inner cylinder portion extends coaxially for a certain distance into the radially smaller bore so as to define a narrow annular space therebetween. An outer peripheral portion of the dividing wall portion is pierced with a groove which extends axially from the radially larger bore side of the dividing wall portion toward the radially smaller bore beyond the thickness of the dividing wall portion, the groove having a radial depth larger than a half of the difference of the diameters of the radially larger and smaller bores, thereby defining a restriction passage which generates a high speed flow of smoke towards the outer peripheral surface of the inner cylindrical member. The radially larger bore is adapted to receive a cigarette.

7 Claims, 4 Drawing Figures

CIGARETTE HOLDER WITH TAR COLLECTING MEANS

BACKGROUND OF THE INVENTION

The present invention relates to a cigarette holder provided with a tar collecting means for purifying cigarette smoke, and, more particularly, relates to a structure for such a cigarette holder provided with tar collecting means, which gives it a good performance in purifying tobacco smoke, and yet which is simple and economical to manufacture.

In the past, a number of different structures have been proposed for a cigarette holder equipped with a tar collecting means. Low cost of mass production of such a cigarette holder is a critical factor, because the salability of such goods is rather price sensitive.

Nevertheless, in view of the desirability of providing a good purifying effect for the tobacco smoke passed through such a cigarette holder with tar collecting means, which is very important in view of the severely high current rates of occurrence of lung cancer, emphysema, bronchitis, heart disease, and other ailments directly attributable to smoking of tobacco, it is important that the percentage of the tarry substances present in tobacco smoke removed therefrom by such a tar collecting means should be high and should remain so at all times during the usable life span of the cigarette holder, until the cigarette holder with tar collecting means is ready to be discarded for a fresh one.

The tar collecting devices which are based upon the principle of blowing the tobacco smoke against a barrier wall at high speed so that tarry particles in the smoke are caught by the carrier wall according to their inertia, while the smoke gases only are diverted away from the barrier wall by being abruptly deflected through a large angle are already well known, and various constructions have been proposed for cigarette holders incorporating such tar collecting means.

However, the requirements for low cost to manufacture and yet for high performance to catch tarry pareticles from tobacco smoke are still pending to be satisfied by a more improved novel construction of a cigarette holder.

SUMMARY OF THE INVENTION

Accordingly, it is the primary object of the present invention to provide such a cigarette holder with tar collecting means, which has a high efficiency of tar collecting operation, and yet which is of a simple construction, and is cheap to manufacture.

It is a further object of the present invention to provide such a cigarette holder with tar collecting means, which can be easily manufactured by injection molding.

It is a yet further object of the present invention to provide such a cigarette holder with tar collecting means, which can be manufactured by injection molding in one molding operation.

It is a yet further object of the present invention to provide such a cigarette holder with tar collecting means, which can be manufactured by injection molding without using a complicated mold.

It is a yet further object of the present invention to provide such a cigarette holder with tar collecting means, which can be manufactured by injection molding without requiring any machine finishing such as drilling.

According to the present invention, these and other objects are accomplished by a cigarette holder comprising a tar collecting means comprising an integrally formed body member comprising: an outer hollow cylindrical portion with open opposite ends and first and second bores extending from the opposite ends toward an axially intermediate position thereof, said first bore having a larger diameter than said second bore; a transverse dividing wall portion extending at said axially intermediate position across the inner space within said hollow cylindrical portion, and separating said first bore and said second bore; an inner cylindrical portion extending from said dividing wall portion coaxially with said outer hollow cylindrical portion for a certain axial distance into said second bore and defining in cooperation with the inner peripheral surface of said hollow cylindrical portion an annular space therebetween; said dividing wall portion being pierced with a groove which extends axially across an outer peripheral portion of said dividing wall portion from the side of said first bore toward the side of said second bore beyond the thickness of said dividing wall portion, said groove having a radial depth larger than a half of the difference between the diameters of said first and second bores, thereby defining a restricted passage which communicates said first bore to said annular space and is defined on its side by a deflecting wall portion which deflects a flow of fluid flowing therethrough toward the outer peripheral surface of said inner cylindrical member; said first bore within said hollow cylindrical member being adapted for a cigarette to be wedged thereinto so as to receive the smoke from said cigarette; said second bore within said hollow cylindrical member being adapted for applying sucking action by a smoker.

According to such a structure, the smoke from the lighted tip of a cigarette, the unlighted end of which is inserted into said first bore within said hollow cylindrical member flows, when suction from the mouth of a cigarette user is applied to said second bore within said hollow cylindrical member, through said passage so as to impinge upon said outer peripheral surface of said inner cylindrical member as deflected by said deflecting wall portion of said passage, and further upon the inner peripheral surface of said hollow cylindrical member as reflected by said outer peripheral surface of said inner cylindrical member, and so on. Because said passage is restricted, the smoke is thereby imparted with a high velocity, and as this smoke collides with the abovementioned surfaces, and as the direction of motion thereof is thereby substantially abruptly altered, the heavier tarry particles within the smoke, which have a substantial inertia relative to air frictional forces acting on their outside surfaces, directly impinge against or are dashed against the abovementioned surfaces, and become stuck thereto. Further, according to the present invention, such a cigarette holder with tar collecting means is very easy to make and very cheap, since said integrally formed body member is a one piece article which may be conveniently formed by the injection molding process in one operation, with no drilling or other machining or assembly process. Therefore, the cigarette holder according to the present invention can be frequently discarded for a fresh one without undue expense.

Further, according to a particular aspect of the present invention, these and other objects are more particularly and concretely accomplished by a device as described above, further comprising a mouthpiece member formed with an inner bore from which extends a smoke outlet passage to which is directly applied the sucking action by the smoker, said integrally formed body member and said mouthpiece member being selectively detachably joined together in such a way that said second bore within said hollow cylindrical member is communicated with said inner bore within said mouthpiece member.

According to such a structure, the mouthpiece member need not be discarded when the tar collecting member is discarded, to make for economy of operation.

Further, according to a particular aspect of the present invention, these and other objects are more particularly and concretely accomplished by such a device as first described above, further comprising a filter mounted in said second bore near its open end remote from said dividing wall portion within said hollow cylindrical member so as to intercept passage of smoke defined by said second bore.

According to such a structure, the smoke from which larger or coarser tar particles have been removed by the impingement of the flow of smoke against the solid surfaces is further purified by being passed through the filter, in which smaller and finer tar particles are effectivcely caught and removed from the smoke without causing early clogging of the filter which would occur when the smoke including the larger and coarser tar particles which are removed by the impingement of the smoke against the solid surfaces were directly passed through the filter.

Further, according to a particular aspect of the present invention, these and other objects are more particularly and concretely accomplished by such a device as described above, wherein said dividing wall portion includes a radially central portion biased for a certain axial distance into said first bore so as to abut a central portion of the end of a cigarette which is inserted into said first bore while leaving an annular space between the end of the cigarette and said dividing wall portion.

According to such a structure, when the cigarette is pushed into said first bore within said hollow cylindrical member, it is avoided that the unlit end of the cigarette comes into contact with said dividing wall portion so as to obstruct the free passage of smoke into said passage.

Further, according to a particular aspect of the present invention, these and other objects are more particularly and concretely accomplished by such a device as described above, wherein said mouthpiece member is so fitted to said integrally formed body member as to allow a certain amount of air to pass from the outside into said inner bore within said mouthpiece member to be mixed with the smoke therein which is being sucked toward the smoker.

According to such a structure, the smoke which is being inhaled by the smoker is mixed with a proportion of fresh air, and thus the density and the coolness of the smoke can be modified.

Further, according to a particular aspect of the present invention, these and other objects are more particularly and concretely accomplished by such a device as described above, wherein said certain amount of air is variable according to the adjustment of said mouthpiece member relative to said integrally formed body member.

According to such a structure, the proportion of fresh air which is mixed with the smoke which is being inhaled by the smoker may be varied by said smoker at will, thus varying the intensity of the aforesaid modification.

BRIEF DESCRIPTION OF THE DRAWINGS

The present invention will now be shown and described with reference to a preferred embodiment thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENT

Figure 1:
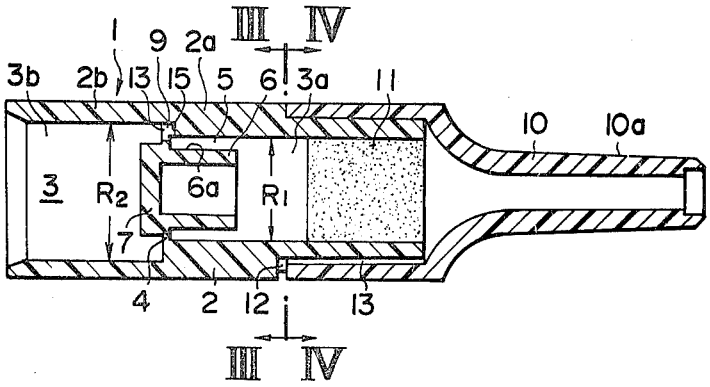
FIG. 1 is a longitudinal sectional view of the preferred embodiment of the cigarette holder incorporating a tar collecting means according to the present invention, which is generally tubular and is easily and cheaply manufacturable in quantity by injection molding, said sectional view being taken in a plane which includes the central axis of said cigarette holder.
Figure 2:
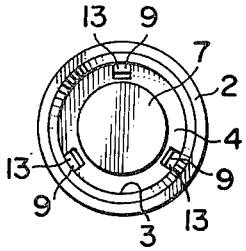
FIG. 2 is an end view of said preferred embodiment of the present invention shown in FIG. 1, as seen from the left hand side of FIG. 1.

The present invention will now be described with reference to the preferred embodiment thereof, and with reference to the appended drawings. In the drawings, parts, openings, and spaces are designated by the same reference numerals and symbols throughout all the figures thereof.

FIG. 7 shows a longitudinal sectional view through a cigarette holder with tar collecting means according to the preferred embodiment of the present invention. This cigarette holder is made up of a generally cylindrical body member generally designated by the reference numeral 1 and a mouthpiece member 10. The body member 1 is formed at its left hand end in FIG. 1 with a bore or cigarette fitting hole 3 which is adapted for the non burning end of a lit cigarette to be inserted thereinto, so as to fix the cigarette in a smoke sealing fashion into the body member 1; and the mouthpiece member 10 is formed with a sucking portion **10*a* which is adapted to be sucked by the mouth of a smoker. Both the body member 1 and the mouthpiece member 10 are formed as hollow members, and are attached together in a coaxial fashion by, in this preferred embodiment of the present invention, the left hand end in FIG. 1 of the mouthpiece member 10 being tightly fitted over the right hand end of the body member 1, by a construction which will be explained in more detail later. Thus, an axially extending smoke passage is defined through the cigarette holder, from the cigarette fitting hole 3 of the body member 1 through to the sucking portion 10*a* of the mouthpiece member 10**.

In more detail, the body member 1 is integrally formed as a one piece member of injection molded synthetic resion, and includes an outer cylindrical portion 2 which is generally constructed in the form of two hollow cylindrical portions 2a and 2b axially abutted together, said two cylindrical portions 2a and 2b being of somewhat differing internal diameters but being of the same outer diameter; and, corresponding to this, the interior space within said body member 1 is composed of two cylindrical bores 3a and 3b end to end with a step being defined therebetween, the smaller diameter one 3a of these two cylindrical bores being defined in the right hand part in FIG. 1 of the body member 1 and being of a length and of a smaller diameter $R_1$ adapted snugly to receive a filter member 11, as will be explained later, while the larger diameter one 3b of these two cylindrical bores is defined in the left hand part in FIG. 1 of the body member 1 and is of a length and of a larger diameter $R_2$ adapted snugly to receive the end of a cigarette (not shown) which is to be inserted therein.

These two cylindrical bores 3a and 3b within the body member 1 are separated, as seen along the axial direction of the body member 1, by a dividing wall portion 4, which extends peripendicularly to the central axis of the body member 1 completely across the internal space therein. The outer peripheral edge of this dividing wall portion 4 is joined to the abovementioned step defined between the inner circumferential surfaces of the cylindrical portions 2a and 2b or between the bores 3a and 3b at the axial position where they abut together, and a central portion of the dividing wall portion 4 is biased toward the bore 3b to provide a cigarette end abutting portion 7 which abuts against a central portion of the end face of a cigarette (not shown) which is inserted in the bore 3b, while an annular groove 13 is formed around the central cigarette end abutting portion 7. From the concaved side of the dividing wall portion 4 an inner cylindrical portion 6 extends coaxially with the outer cylindrical portion 2 of the body member 1 within the smaller cylindrical bore 3a. The inner cylindrical portion 6 is of an appropriate radial dimension for a narrow cylindrical space 5 of annular cross section to be defined between its outer surface and the inner surface of the cylindrical portion 2a of the body member 1, said annular space being restricted in its radial depth so as to maintain a high speed of the flow of the smoke flowing therethrough.

The dividing wall portion 4 is penetrated by three restricted passages 9, in the shown embodiment. As one of them is shown in its longitudinal section in FIG. 1, the restricted passage 9 is formed by a groove 14, which extends axially across an outer peripheral portion of the dividing wall portion 4 from the side of the cylindrical bore 3b toward the side of the cylindrical bore 3a beyond the thickness of the dividing wall portion 4, and which has a radial depth which is larger than a half of the difference between the diameter $R_2$ of the larger cylindrical bore 3b and the diameter $R_1$ of the smaller cylindrical bore 3a. Therefore, a corner portion where the inner peripheral surface of the cylindrical portion 2a joins with the outer peripheral portion of the dividing wall portion 4 is cut off as a part of the groove 13 so that the groove 13 which merely extends axially across the outer peripheral portion of the dividing wall portion 14 forms the restricted passage 9 which communicates the cylindrical bore 3b to the annular space 5 in the cylindrical bore 3a and is defined to the side by a deflecting wall portion 15 so as to discharge an accelerated flow of smoke therethrough to abut against the outer peripheral surface 6a of the inner cylindrical portion 6 nearly at right angles thereto.

The body member 1 comprising the outer cylindrical portion 2 of the cigarette holder including the cylindrical portions 2a and 2b, the dividing wall portion 4, and the inner cylindrical portion 6, is formed by injection molding as a one piece member in one forming operation by the use of a two piece type injection mold (not shown in the figures), the one forming a half axial portion of the body member 1 on one side of the dividing wall portion 4 and the other forming another half axial portion of the body member 1 on the other side of the dividing wall portion 4 and the two forming in cooperation the dividing wall portion 4 with its restricted passages 9 also being formed during this injection molding process; the two pieces of the injection mold are axially separated and removed from the formed body member 1, after injection molding; the other details will be clear to one of ordinary skill in the injection molding art, based upon the disclosure herein, without any additional explanation. This particular design feature of the body member 1, which is the main portion of the cigarette holder, means that the cigarette holder is cheap and easy to make and is well adapted for mass production, since no post finishing of the injection molded plastic product (such as drilling or assembly) is required.

In the open end of the outer cylindrical portion 2a is securely fitted a filter member 11 of a per se well known sort, which is cylindrical in shape, so as to intercept the smoke passage defined therethrough. The filter 11 is securely jammed into the inner cylindrical surface of the cylindrical portion 2a.

Figure 3:
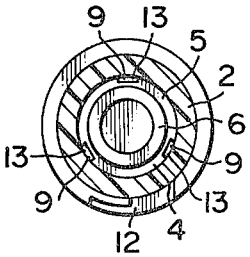
FIG. 3 is a sectional view of said preferred embodiment of the present invention, taken in a plane and as seen in a direction indicated in FIG. 1 by the lines III—III.
Figure 4:
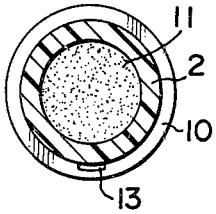
FIG. 4 is a sectional view of said preferred embodiment of the present invention, taken in a plane and as seen in a direction indicated in FIG. 3 by the lines IV—IV.

Finally, on the open end of the cylindrical portion 2a there is fitted a mouthpiece member 10, the free end portion 10a of which is formed in a shape adapted to be sucked upon by the mouth of a smoker. In the shown preferred embodiment of the present invention the open end portion of the cylindrical portion 2a is narrowed down, and the mouthpiece member 10 is fitted over the narrowed down free end portion of the cylindrical portion 2a so as to be slidably rotatable and removable. Further, a groove 13 is formed along the inside of the portion of the mouthpiece member which fits over the end of said cylindrical portion 2a. A cutaway 12 of a cross sectional shape such as shown in FIG. 3 is formed on the flange portion of the outer surface of the cylindrical portion 2a so as to cooperate with said groove 13 in such a way that, as said mouthpiece member 10 is rotated with respect to the cylindrical portion 2a, the resistance presented to flow of air from the outside past said cutaway 12 through said groove can be varied from a substantially infinite value down to a quite low value; and thus a variably adjustable amount of air can be admixed with the smoke which is being sucked by the smoker using the cigarette holder, according to his desire.

The operation of this cigarette holder with tar collecting means according to the preferred embodiment of the present invention will now be described.

When a cigarette is inserted into the cigarette fitting hole 3, with its unlit end (its right end) abutting against the left hand end in the figure of the cigarette end abutting portion 7 of the dividing wall portion 4, and when the other end of the cigarette is lit and the mouth of a smoker sucks on the free end portion 10a of the mouthpiece member 10, then cigarette smoke is sucked from the cigarette, into the space of the annular groove 13 and through the restricted passages 9 through the dividing wall portion 4. As this smoke passes through the passages 9, as deflected by the deflecting wall portion 15, it acquires a substantial radially inward component of motion, as mentioned above. At the same time, the smoke is accelerated to high speed and flows through the restricted passages 9. Next, the smoke impinges against the outer surface 6*a* of the inner cylindrical portion 6 at a not very shallow angle at high speed, and the direction of motion thereof is substantially abruptly altered. At this time the heavier tarry particles within the smoke, which have a substantial inertia relative to air frictional forces acting on their outside surfaces, directly impinge against or are dashed against said outer surface of said inner cylindrical portion 6 and become stuck thereto. Thus, the smoke is purified of its coarser tar particles, which remain stuck according to their stickiness and viscosity to said surface of said smaller portion 6. Since the annular space 5 is relatively narrow, the flow of smoke which impinged against the outer surface 6*a* of the inner cylindrical portion 6 and was reflected by the outer surface 6*a* then further impinges against the inner surface of the outer cylindrical portion 2*a* and some tarry particles still remaining in the smoke are caught by the inner surface of the cylindrical portion 2*a*. Such a tarry particles collecting process is repeated, though gradually diminished, as the flow of smoke flows through the narrow annular space 5 in a turbulent condition.

Thereafter, the smoke enters into the cylindrical bore 3*a*, whence the smoke passes through the filter 11 wherein it is purified of the finer tarry particles which are still present in the smoke by the finer tarry particles sticking to the sides of various micropassages fomred in the filter 11 in a per se well known way, the total surface area of all the sides of all said micropassages being very large. Subsequently, the smoke passes out of the right hand side in FIG. 1 of the filter 11, whence it enters into the space within the mouthpiece member 10. At this time, the smoke is mixed with a stream of air which is being sucked in through the groove 13 from the outside, the amount of this sucked in and admixed air being determined, as explained above, by the angular position of the mouthpiece member 10 relative to the cylindrical portion 2*a*. Finally, the smoke then is sucked out of the sucking end 10*a* of the mouthpiece member 10 toward the smoker.

As this purification action proceeds over some time, of course the parts of the outer surface of the inner cylindrical portion 6 and the inner surface of the cylindrical portion 2*a* against which the smoke is impinging become plastered with tarry paste; and indeed finally the whole surface of said portion 6 becomes tarry. However, because according to the present invention the cigarette holder as a whole is very cheap and easy to make, at least the body member 1 can be frequently discarded for a fresh one without undue expense. Thus problems of choking up can be avoided.

Although the present invention has been shown and described with reference to a preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention.

What is claimed is:

1. A cigarette holder comprising a tar collecting means comprising an integrally formed body member comprising:

an outer hollow cylindrical portion with open opposite ends and first and second bores extending from the opposite ends toward an axially intermediate position thereof, said first bore having a larger diameter than said second bore;

a transverse dividing wall portion extending at said axially intermediate position across the inner space within said hollow cylindrical portion, and separating said first bore and said second bore;

an inner cylindrical portion extending from said dividing wall portion coaxially with said outer hollow cylindrical portion for a certain axial distance into said second bore and defining in cooperation with the inner peripheral surface of said hollow cylindrical portion an annular space therebetween;

said dividing wall portion being pierced with a groove which extends axially across an outer peripheral portion of said dividing wall portion from the side of said first bore toward the side of said second bore beyond the thickness of said dividing wall portion, said groove having a radial depth larger than a half of the difference between the diameters of said first and second bores, thereby defining a restricted passage which communicates said first bore to said annular space and is defined on its side by a deflecting wall portion which deflects a flow of fluid flowing therethrough toward the outer peripheral surface of said inner cylindrical member;

said first bore within said hollow cylindrical member being adapted for a cigarette to be wedged thereinto so as to receive the smoke from said cigarette;

said second bore within said hollow cylindrical member being adapted for applying sucking action by a smoker.

2. A cigarette holder according to claim 1, further comprising a mouthpiece member formed with an inner bore from which extends a smoke outlet passage to which is directly applied the sucking action by the smoker, said integrally formed body member and said mouthpiece member being selectively detachably joined together in such a way that said second bore within said hollow cylindrical member is communicated with said inner bore within said mouthpiece member.

3. A cigarette holder according to claim 2, wherein said mouthpiece member is so fitted to said integrally formed body member as to allow a certain amount of air to pass from the outside into said inner bore within said mouthpiece member to be mixed with the smoke therein which is being sucked toward the smoker.

4. A cigarette holder according to claim 3, wherein said certain amount of air is variable according to the adjustment of said mouthpiece member relative to said integrally formed body member.

5. A cigarette holder according to claim 1, further comprising a filter mounted in said second bore near its open end remote from said dividing wall portion within said hollow cylindrical member so as to intercept passage of smoke defined by said second bore.

6. A cigarette holder according to claim 1, wherein a plurality of said grooves are formed along the peripheral portion of said dividing wall portion so as to provide a plurality of said passages.

7. A cigarette holder according to claim 1, wherein said dividing wall portion includes a radially central portion biased for a certain axial distance into said first bore so as to abut a central portion of the end of a cigarette which is inserted into said first bore while leaving an annular space between the end of the cigarette and said dividing wall portion.

* * * * *